United States Patent [19]

Lai

[11] 4,086,777

[45] May 2, 1978

[54] APPARATUS FOR LAUNCHING BATTERED LEG JACKETS FOR OFFSHORE PLATFORMS

[75] Inventor: Chiang-Chun Lai, Tulsa, Okla.

[73] Assignee: Standard Oil Company (Indiana), Chicago, Ill.

[21] Appl. No.: 750,064

[22] Filed: Dec. 13, 1976

[51] Int. Cl.[2] ..... E02B 17/00; B63C 13/00

[52] U.S. Cl. ..... 61/97; 114/27; 114/258; 114/264; 193/38

[58] Field of Search ..... 61/87, 97, 96, 94, 66, 61/67, 93; 114/264, 45, 265 R, 27, 258, 259, 260; 214/15 R, 85, 85.1; 193/38, 41

[56] References Cited

U.S. PATENT DOCUMENTS

| | | | |
|---|---|---|---|
| 2,379,685 | 7/1945 | Crandall | 114/45 |
| 3,850,107 | 11/1974 | Klinkhammer | 61/66 X |
| 3,859,806 | 1/1975 | Guy et al. | 61/96 |
| 3,878,688 | 4/1975 | Colin | 114/45 X |

*Primary Examiner*—Jacob Shapiro
*Attorney, Agent, or Firm*—R. A. Stoltz

[57] ABSTRACT

This apparatus is for use in the launching of battered leg jackets for offshore platforms. The jacket is transported on at least one barge resting on its lower battered legs and, during launching, the apparatus guides the jacket by its lower battered legs to maintain the center line of the jacket on the launching center line. The apparatus uses a pair of dollies on a beam, and at least two beams on a barge. The beams are mounted transverse to the launching center line. The dollies can move along the transverse beam and position coordinating means are used to control the relative positions of the dollies on each beam such that the two dollies are maintained essentially the same distance from the launching center line with one dolly on either side of the launching center line. When either dolly is moved, the other dolly on the same beam will move the same distance in the opposite direction. The dollies are adapted to maintain the battered legs on top of the dolly and the leg slides through the guide on top of the dolly (thus any movement of the dolly relative to the leg is along the length of the leg). As the legs stay on top of the dollies and as the dollies in a pair stay the same distance from the launching center line, the legs are maintained the same distance from the launching center line and the jacket is kept centered as the legs slide through the dollies during launching. For example, if the jacket is launched small end (top) first, the distance between the legs will increase as the legs slide through the dollies, and the dollies on each transverse beam will move apart.

5 Claims, 7 Drawing Figures

APPARATUS FOR LAUNCHING BATTERED LEG JACKETS FOR OFFSHORE PLATFORMS

BACKGROUND OF THE INVENTION

This invention is of an apparatus for use in launching a jacket for an offshore platform for oil production purposes or any other purpose and, in particular, is for a battered leg, rather than parallel leg, jacket.

While some jackets for offshore platforms are built with special flotation chambers and towed to the location at which they will be erected, it is often more convenient to load the jacket on one or more barges for towing the jacket to location. Barges for transporting jackets for offshore platforms are discussed, for example, in the following U.S. patents: U.S. Pat. No. 3,315,473 issued to Hauber, et al., on Apr. 25, 1967; U.S. Pat. No. 3,859,806 issued to Guy, et al., on Jan. 14, 1975; and U.S. Pat. No. 3,937,027 issued to Koehler, et al., on Feb. 10, 1976.

Once a jacket loaded on the barge arrives at location, the jacket must be unloaded. Unloading techniques used for battered leg jackets in the past include partially submerging the barge, or using one or more derrick barges to lift the jacket. Both of these methods are expensive and become especially difficult with larger jackets. It has been proposed that the jacket be constructed with two parallel extra legs located between the lower battered legs (lower as the jacket is transported on the barge). The parallel legs can slide on a pair of skid rails such that the center line of the jacket will be maintained over the launching center line as the jacket moves toward (and off) the launching end of the barge. In this way, the jacket and the barge position could be maintained to avoid possible instability and damage to the barge and/or jacket. While such a system would be technically satisfactory, including two extra legs on the jacket would not be economically feasible for a wide range of water depths.

SUMMARY OF THE INVENTION

It has been discovered that a battered leg jacket for an offshore platform can be conveniently maintained on the launching center line by using a pair of dollies of each of at least two beams mounted transverse (perpendicular) to the launching center line. The dollies support the jacket in a horizontal position on the barge by its two lower battered legs. The dollies move along the transverse beam perpendicular to the launching center line and their relative movement is coordinated by a coordinating means which maintains the two dollies on each beam essentially at the same distance from the launching center line. Thus, the dollies in the pair move equal distances in opposite directions during launching, and guide the battered legs of the jacket to maintain the jacket on the launching center line. Rocker decks are preferably used with dollies on at least two transverse beams on the rocker deck. Large jackets can be supported by more than one such barge.

BRIEF DESCRIPTION OF THE DRAWINGS

A better understanding of the invention may be obtained by reference to the accompanying drawings in which.

DESCRIPTION OF THE PREFERRED EMBODIMENTS

Figure 1:
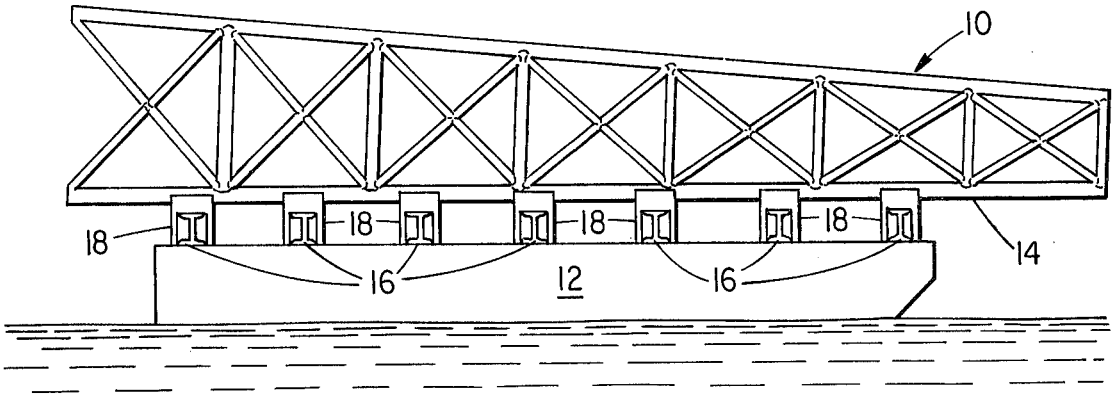
FIG. 1 is an elevation showing a side view of a battered leg jacket on a barge.

FIG. 1 shows a battered leg jacket 10 supported by a barge 12 on the two lower legs 14 of the jacket 10. Transverse beams 16 are mounted on the barge and pairs of dollies 18 are mounted on each transverse beam 16.

Figure 2:
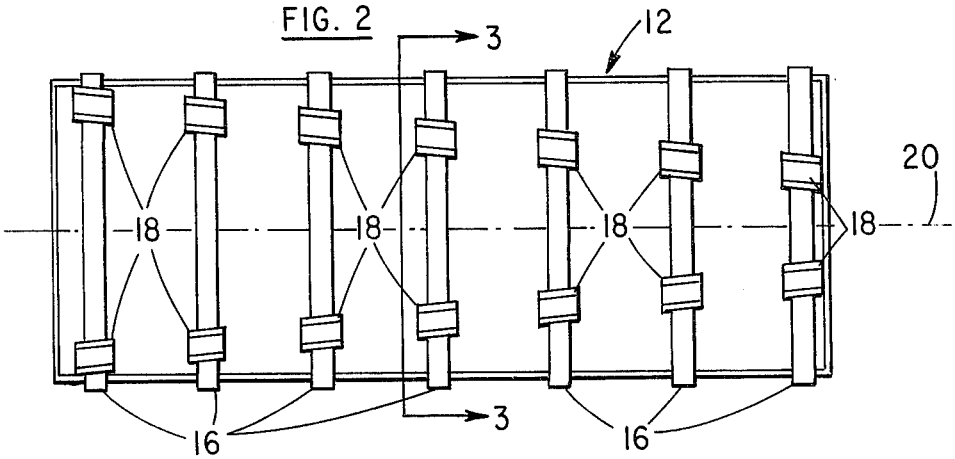
FIG. 2 is a plan view of a barge showing the transverse beams and the launching center line.

FIG. 2 shows a plan view of barge 12 with its transverse beams 16 and pairs of dollies 18 on each transverse beam 16. The launching center line is indicated by the dot-dash line 20 and here is directly on top of the longitudinal center line of the barge 12.

Figure 3:
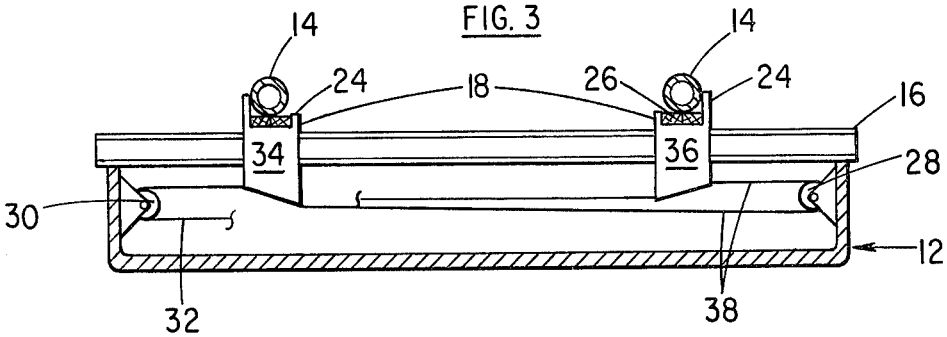
FIG. 3 is a sectional view of one embodiment of a dolly position coordinating means.

FIG. 3 is a cross section through barge 12 to show an embodiment of a dolly position coordinating means. Here dollies 18 are generally saddle-shaped with skirt portions which hang down on either side of the beam to keep the dollies 18 on the beam 16 and with upper guide portions 24 which guide jacket lower legs 14 to keep legs 14 on the dollies 18. Preferably, timbers 26 or some other intermediate support are attached to lower legs 14 to prevent damage to legs 14 as they slide through the dollies 18. The dolly position coordinating means for this pair of dollies 18 comprises two cables and two pulleys. Assuming that the jacket were to be launched away from the viewer of FIG. 3, then the right side of FIG. 3 would be the launching starboard side and the left side of FIG. 3 would be the launching port side. Pulley 28 is mounted near the launching starboard end of the transverse beam and pulley 30 is mounted near the launching port end of the transverse beam. A first cable 32 is connected to the launching port side of launching port dolly 34 and run around port pulley 30 and connected to the port side of starboard dolly 36. A second cable 38 is connected to the launching starboard side of the starboard dolly 36, run around the starboard pulley 28 and connected to the starboard side of the port dolly 34. It can be seen that this arrangement can maintain the dollies at equal distances from the launching centerline.

Attaching cable 32 to the port side of dollies 34 and 36 and cable 38 to the starboard side of the dollies is convenient, but these cables could, of course, be connected in other manners, including in the center of the dolly. Similarly, a single cable could be connected to the center of the port dolly 34 around the port pulley 30, clamped to the starboard dolly 36, around the starboard pulley 28, and connected back to the center of the port dolly 34.

Figure 4:
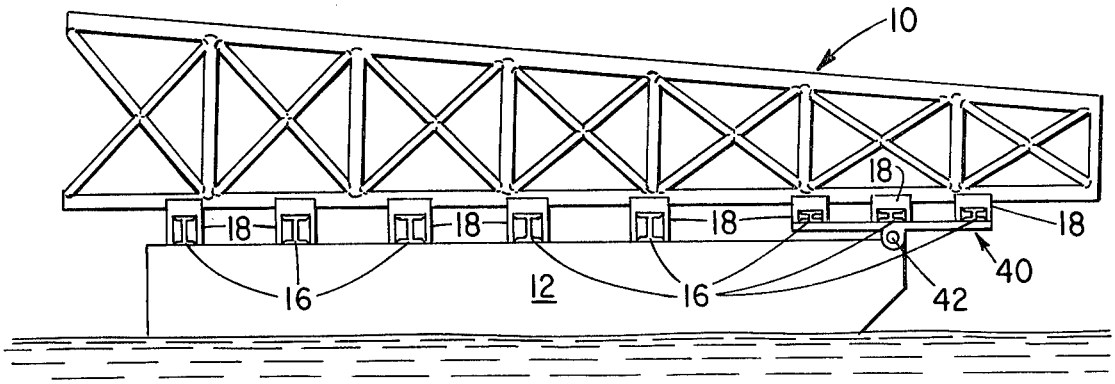
FIG. 4 is a side elevation showing a battered leg jacket on a barge which has a rocker deck.

FIG. 4 illustrates the use of a rocker deck. Rocker deck 40 can pivot about its support 42 and provides support for jacket 10 over a larger area during the latter stages of launching, i.e., when one end of jacket 10 is floating while the other end of jacket 10 is still being supported by the barge 12. At least two, and here three, transverse beams 16 (each with a pair of dollies 18 mounted thereon) are mounted on the rocker deck (and at least one beam with dollies is mounted on the remaining portion of the barge). As the rocker deck 40 can tilt, jacket 10 is still being guided down the launching center line, even when, as described above, the center of gravity of jacket 10 is off barge 12 and one end of jacket 10 is floating in the water.

Figure 5:
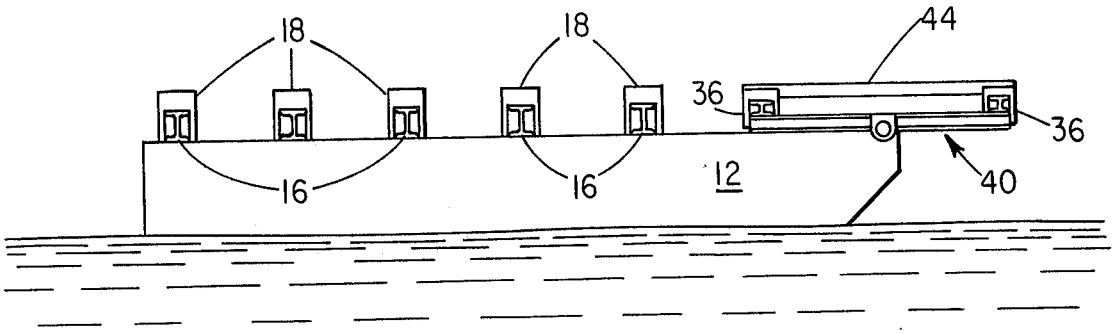
FIG. 5 is a side elevation of a barge showing an embodiment in which there is a common guiding means connecting starboard dollies and a second common guiding means connecting port dollies on the rocker deck.
Figure 6:
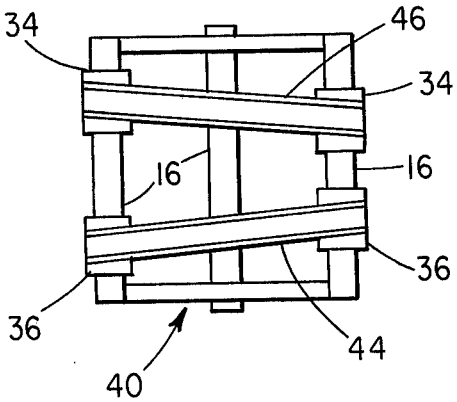
FIG. 6 is a plan view showing the common guiding means of FIG. 5.

FIG. 5 shows an elevation of barge 12 on which one common guiding means is used between two launching starboard dollies 36 and a second common guide means is used between two launching port dollies 34. Here, two transverse beams 16 are mounted on rocker deck 40 and starboard dollies 36 on these beams are connected by a trough-shaped common guiding means 44. FIG. 6 shows a plan view of rocker deck 40 with common guiding means 44 between the starboard dollies 36. A second common guiding means 46 connects two port dollies 34. Common guiding means can, of course, also be used on the main portion of the barge and also between more than two dollies. The common guiding means 46 and 44 can be rigidly attached to the dollies as the legs of the battered leg jacket generally are straight and thus have a constant angle between the legs. It is convenient, however, to allow for some relative motion between the common guide means and at least one of the dollies which supports it, and such an arrangement could also be used with battered legs which are not straight.

Figure 7:
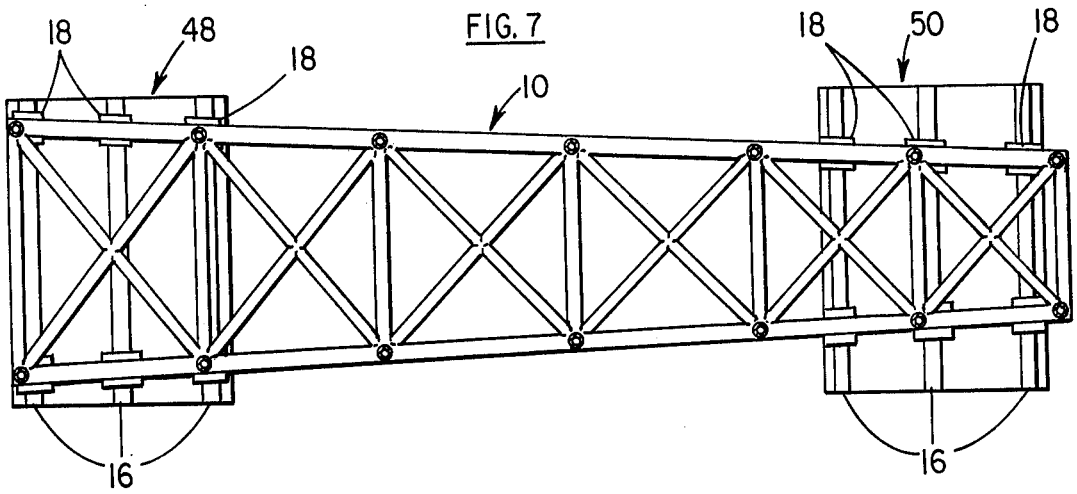
FIG. 7 is a plan view of a battered leg jacket (in section with the upper portion of the jacket removed) supported by two barges.

While the foregoing has been described generally for arrangements in which the small end of the jacket (which, after erection will be the upper end of the platform, above the water) is launched first, the jackets can, of course, be launched with the larger end (the base which will be at the ocean bottom after erection) launched first. If the base is launched first, the dollies will, of course, move together during launching, instead of apart. Further, the preceding has generally shown the launching center line to be parallel to the longitudinal center line of the barge. This need not be the case and while the launching center line is always in the same direction as the longitudinal center line of the jacket, these center lines can be perpendicular to the longitudinal center line of the barge. This is the case in, for example, FIG. 7 where two barges are used. Here a first barge 48 supports the base of jacket 10 and a second barge 50 supports the small end of jacket 10. Jacket 10 in FIG. 7 could be launched, for example, by first pulling barge 50 out from under the small end and then allowing the jacket 10 to slide off barge 48. Conversely, barge 48 could be pulled towards the center and underneath the center of gravity of jacket 10, and then barge 50 pulled out from under jacket 10, leaving jacket 10 balanced on barge 48. Jacket 10 could then be launched off barge 48. In either case, the jacket is guided down the launching center line by the pairs of dollies as described herein.

As used herein, the term "jacket" may mean jacket section and not necessarily a complete jacket for the platform and two or more jacket sections can be brought out on two or more separate barges and launched (and then joined together in the water such as described in the aforementioned patent, U.S. Pat. No. 3,859,806, for example).

There are, of course, many other possible configurations of dolly position-coordinating means. Combinations of gearing and cables, or even direct gearing can be used to maintain the dollies on each beam essentially the same distance from the launching center line. Various means can also be used for allowing easier movement of the jacket legs through the dollies and also of dolly movement along the transverse beam. Either of these movements can be facilitated by greasing the surfaces or by providing the wheels and/or rollers on the dollies, for example.

The invention is not to be construed as limited to the particular forms described herein, since these are to be regarded as illustrative rather than restrictive. The invention is intended to cover all configurations which do not depart from the spirit and scope thereof.

I claim:

1. Apparatus for use in launching a battered leg jacket for an offshore platform from at least one barge, the platform jacket being generally supported in a horizontal position on the barge by its two lower battered legs and being launched by moving the jacket along the launching center line and off the launching end of the barge, said apparatus comprising:

(a) At least two beams mounted on the barge transverse to the launching center line;

(b) a pair of dollies mounted on each of said beams and movable along the length of said beam, one dolly on each side of the launching center line and each dolly providing support for one of the lower battered legs and adapted to guide the leg so that any movement of the leg relative to the dolly is along the length of the leg; and (c) a dolly position-coordinating means connected to each of said pairs of dollies to maintain the two dollies on each beam essentially the same distance from the launching center line, whereby during launching the dollies guide the battered legs of the jacket and the jacket is maintained on the launching center line.

2. The apparatus of claim 1, wherein a rocker deck is mounted on the launching end of the barge and at least two transverse beams are mounted on said rocker deck with a pair of dollies on each transverse beam and at least one pair of dollies on a transverse beam is mounted on the remaining portion of the barge.

3. The apparatus of claim 2, wherein a first common guiding means connects at least two launching starboard dollies and a second common guiding means connects at least two launching port dollies.

4. The apparatus of claim 1, where the jacket is supported on two barges.

5. Apparatus for use in launching a battered leg jacket for an offshore platform from at least one barge, the platform jacket being generally supported in a horizontal position on the barge by its two lower battered legs and being launched by moving the jacket along the launching center line and off the launching end of the barge, said apparatus comprising:

(a) at least two beams mounted on the barge transverse to the launching center line;

(b) a pair of dollies mounted on each of said beams and movable along the length of said beam, one dolly on each side of the launching center line and each dolly providing support for one of the lower battered legs and adapted to guide the leg so that any movement of the leg relative to the dolly is along the length of the leg; and (c) a dolly position-coordinating means connected to each of said pairs of dollies to maintain the two dollies on each beam essentially the same distance from the launching center line, with said dolly position-coordinating means for the pair of dollies mounted on each beam comprising at least one pulley mounted near the launching port end of that transverse beam and at least one pulley mounted near the launching starboard end of that transverse beam and at least one cable portion connected to the dolly on the launching port side and run around the port pulley and connected to the other of said pair of dollies and at least one cable portion connected to the dolly on the launching starboard side and run around the starboard pulley and connected to the port side dolly, whereby during launching the dollies guide the battered legs of the jacket and the jacket is maintained on the launching center line.

* * * * *